United States Patent [19]

Stewart

[11] 4,345,993

[45] Aug. 24, 1982

[54] CONTROL OF A FLUID CATALYTIC CRACKING UNIT

[75] Inventor: William S. Stewart, Bartlesville, Okla.

[73] Assignee: Phillips Petroleum Company, Bartlesville, Okla.

[21] Appl. No.: 221,680

[22] Filed: Dec. 30, 1980

[51] Int. Cl.[3] ..... C10G 11/18; G05D 7/00; G05D 23/00; F27B 15/00

[52] U.S. Cl. ..... 208/164; 208/DIG. 1; 208/113; 208/159; 422/111; 422/144

[58] Field of Search ..... 422/111, 144; 208/DIG. 1, 113, 164, 159

[56] References Cited

U.S. PATENT DOCUMENTS

| | | | |
|---|---|---|---|
| 3,175,968 | 3/1965 | Berger | 208/164 |
| 3,378,483 | 4/1968 | Worrell et al. | 208/164 |
| 3,591,783 | 7/1971 | Zumwalt | 208/164 |
| 3,687,841 | 8/1972 | Saxton et al. | 208/164 |
| 3,728,526 | 4/1973 | Youngblood | 208/DIG. 1 |
| 3,769,203 | 10/1973 | Lee et al. | 208/164 |
| 3,781,533 | 12/1973 | Barnstone et al. | 208/DIG. 1 |
| 3,828,171 | 8/1974 | Griffin | 208/164 |
| 3,838,256 | 9/1974 | Mosler | 208/DIG. 1 |
| 4,149,963 | 4/1979 | Hann | 208/164 |
| 4,217,243 | 8/1980 | Christie | 208/164 |

*Primary Examiner*—Delbert E. Gantz
*Assistant Examiner*—Olik Chaudhuri

[57] ABSTRACT

A fluid catalytic cracking unit (FCCU) is controlled in such a manner that load is automatically shifted from the wet gas compressor to the air blower for the catalyst regenerator if the loading on the wet gas compressor becomes a limiting factor on the yield of a desired product from the FCCU. Also, the preheat temperature for the feed flowing to the reactor is automatically increased if the desired temperature in the reactor cannot be maintained by increasing catalyst flow to the reactor without exceeding an air blower limitation. This automatic load shifting provides for a substantially maximum production of a desired product without exceeding a process limitation.

18 Claims, 2 Drawing Figures

CONTROL OF A FLUID CATALYTIC CRACKING UNIT

Figure 1:
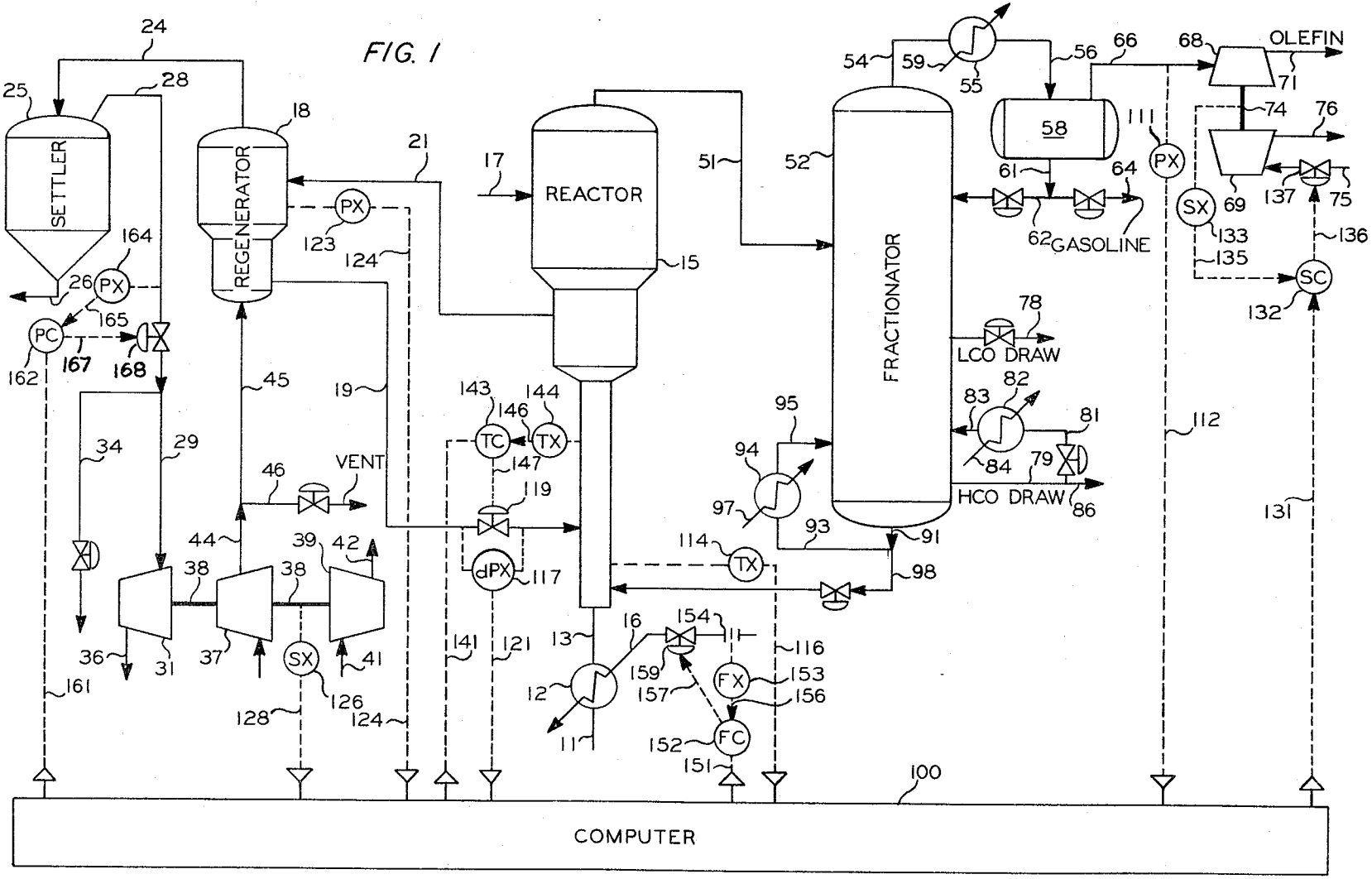

This invention relates to control of a fluid catalytic cracking unit (FCCU). In one aspect, this invention relates to method and apparatus for automatically shifting the load from the wet gas compressor to the air blower for the catalytic regenerator if the loading on the wet gas compressor becomes a limiting factor on the yield of a desired product from the FCCU. In another aspect this invention relates to method and apparatus for automatically maintaining a desired temperature in the riser portion of the reactor without exceeding an air blower limitation. In still another aspect this invention relates to method and apparatus for automatically increasing the feed preheat temperature if the desired temperature in the riser portion of the reactor cannot be maintained by increasing catalyst flow to the reactor without exceeding an air blower limitation.

An FCCU is generally made up of a reactor, a catalyst regenerator and a fractionator plus associated equipment. An FCCU is commonly used to crack a feedstock, such as gas oil, into lighter products such as gasoline. As with any process, a primary objective of the operator is to maximize the production of a desired product while maintaining a low cost per unit volume of the desired product. This is especially true in an FCCU in which it is desirable to run as much feedstock through the reactor as possible while maintaining a desired conversion of the feedstock to a desired product so as to substantially maximize the production of the desired product.

As with any process, constraints are associated with an FCCU which may not be exceeded. These constraints range from loading limits on compressors to various required differential pressures and temperature limits. If a process constraint is reached, production will be limited by that process constraint unless a load can be shifted or the process constraint can be avoided in some other way.

For an FCCU, the first constraint generally met, as the flow of feed to the reactor is increased, is the maximum speed of the wet gas compressor associated with the fractionator. In the past, a low suction pressure has been maintained for the wet gas compressor in order to ensure that low operating pressures are maintained in the reactor and catalyst regenerator and also ensure that a pressure differential exists between the regenerator and reactor which will not allow feed to flow to the regenerator. However, a low suction pressure means that the wet gas compressor must operate at a higher speed as more feed is supplied to the reactor. In the past, it has been common to stop increasing the supply of feed to the reactor when the wet gas compressor reaches its maximum speed so as to ensure that the suction pressure for the wet gas compressor does not rise. It is thus an object of this invention to provide method and apparatus for automatically shifting the load from the wet gas compressor to the air blower for the regenerator if the loading on the wet gas compressor becomes a limiting factor on the yield of a desired product from the FCCU in order to avoid the constraint imposed by the maximum wet gas compressor speed. It is also an object of this invention to accomplish the load transfer between the wet gas compressor and the air blower for the regenerator while maintaining a desired pressure diferential between the regenerator and reactor so as to prevent feed from flowing to the regenerator and causing a fire or other serious damage.

The temperature that must be maintained in the riser portion of the FCCU reactor to substantially maximize conversion of the feed to a particular desired product is generally known. Thus, it is desirable to be able to increase the flow of feed to the reactor while maintaining the desired temperature in the riser portion of the reactor. In general, it is preferred in an FCCU to use the heat associated with the fresh catalyst to maintain the desired temperature in the riser portion of the reactor. The preheat temperature for the feed is preferably held at a minimum level so as to increase the flow of fresh catalyst to maintain the desired temperature in the riser portion of the reactor and thus conversion is substantially maximized. However, the air blower for the catalyst regenerator must supply sufficient oxygen to the catalyst regenerator to burn the carbon off the spent catalyst. As the flow of feed increases, the flow of fresh catalyst will necessarily increase to maintain the desired temperature in the riser portion of the reactor and thus more oxygen will be required to burn carbon off of the catalyst because of the greater catalyst circulation rate. A limit on the amount of oxygen which may be supplied from the air blower may be reached and production will be constrained by this limit unless the load can be shifted from the air blower. It is thus another object of this invention to provide method and apparatus for automatically maintaining a desired temperature in the riser reactor without exceeding an air blower limitation. It is another object of this invention to provide method and apparatus for automatically increasing the feed preheat temperature if the desired temperature in the riser reactor cannot be maintained by increasing catalyst flow to the reactor without exceeding an air blower limitation to thereby avoid the constraint imposed by an air blower limitation on the flow of fresh catalyst to the reactor.

In accordance with the present invention, load is shifted from the wet gas compressor to the air blower for the regenerator by allowing the suction pressure for the wet gas compressor to rise if the wet gas compressor reaches a maximum speed. This allows the wet gas compressor to discharge a higher volume of gas but causes the air blower to do more work because a rise in suction pressure for the wet gas compressor causes the regenerator pressure to rise to maintain a desired pressure differential between the regenerator and the reactor and the air blower must supply air to this higher pressure. This load shifting allows production to be increased without exceeding a speed limitation for the wet gas compressor.

Also in accordance with the present invention, load is shifted from the air blower to the feed preheat system by increasing the temperature of the feed prior to contact with the catalyst if the desired temperature in the riser portion of the reactor cannot be maintained by increasing catalyst flow to the reactor without exceeding a limitation on the amount of air which can be supplied from the air blower to the regenerator. This load shifting allows the flow of feed to be increased without reducing the temperature in the riser reactor below some desired temperature and without exceeding a limitation on the amount of air which may be supplied from the air blower to the regenerator. Thus, production is again allowed to increase by avoiding a process limitation.

Figure 2:
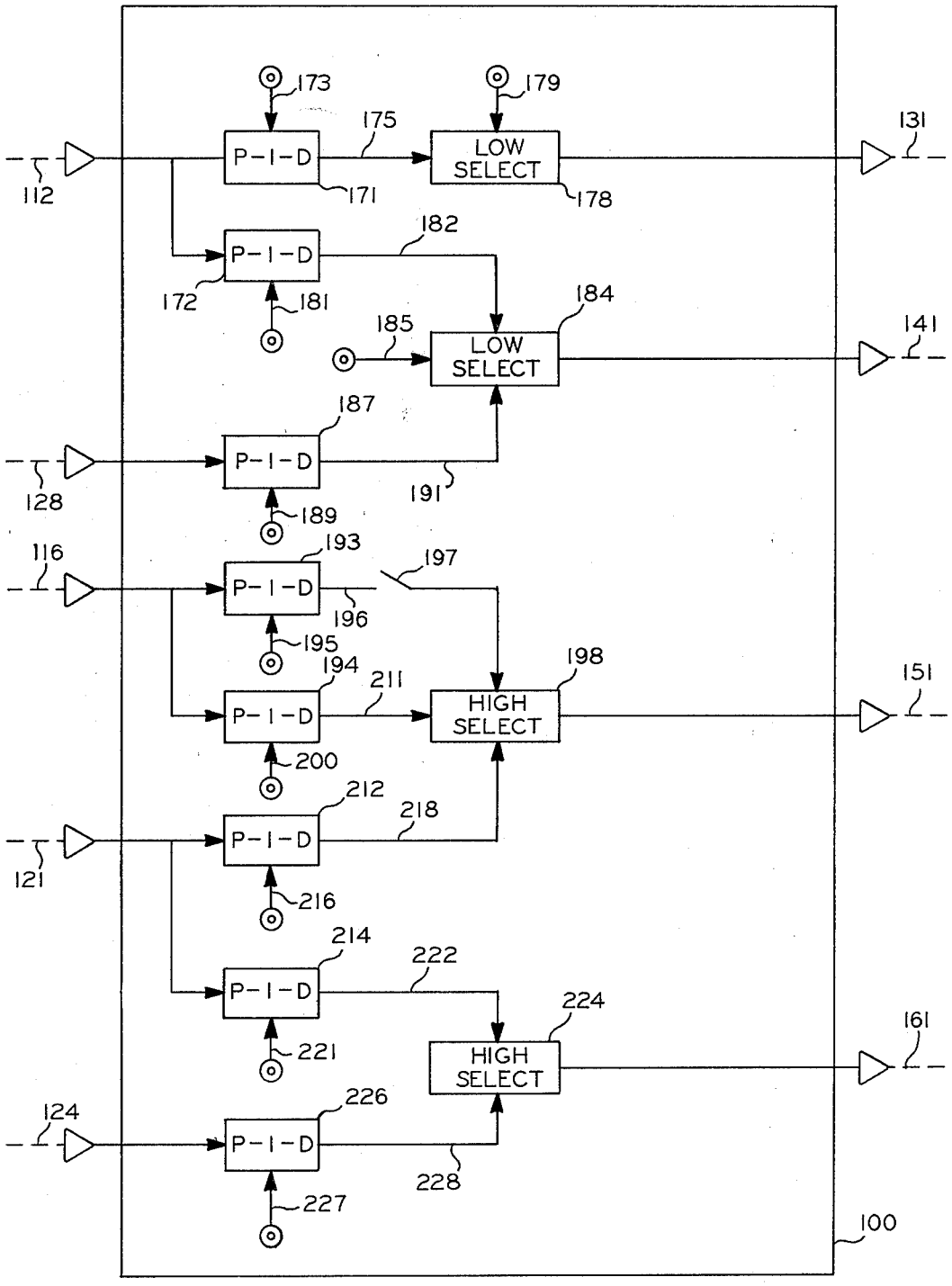

Other objects and advantages of the invention will be apparent from the foregoing brief description of the invention and the claims as well as the detailed description of the drawings in which:

FIG. 1 is a diagrammatic illustration of an FCCU with an associated control system; and FIG. 2 is a logic diagram of the preferred computer logic utilized to implement the desired control functions.

The invention is illustrated and described in terms of a particular FCCU configuration. However, the invention is also applicable to other FCCU configurations. The invention is also described in terms of an FCCU in which gas oil is utilized as a feedstock and the primary objective is to produce gasoline. However, other feedstocks may be utilized and the most desired product may be other than gasoline. The invention is also described in terms of supplying air to the regenerator to supply the oxygen required to burn off carbon from the spent catalyst. Air is generally the fluid utilized to supply oxygen to the regenerator but any suitable fluid containing free oxygen may be utilized if desired.

Only those portions of the control system for an FCCU necessary to illustrate the present invention are set forth in FIG. 1. A large amount of additional control equipment will be utilized to control the FCCU but these additional control elements have not been illustrated for the sake of clarity in illustrating the present invention. Additional control elements required for an FCCU are well known from the many years that FCCU's have been utilized.

A specific control system configuration is set forth in FIG. 1 for the sake of illustration. However, the invention extends to different types of control system configurations which accomplish the purpose of the invention. Lines designated as signal lines in the drawings are electrical or pneumatic in this preferred embodiment. Generally, the signals provided from any transducer are electrical in form. However, the signals provided from flow sensors will generally be pneumatic in form. Transducing of these signals is not illustrated for the sake of simplicity because it is well known in the art that if a flow is measured in pneumatic form it must be transduced to electrical form if it is to be transmitted in electrical form by a flow transducer. Also, transducing of the signals from analog form to digital form or from digital form to analog form is not illustrated because such transducing is also well known in the art.

The invention is also applicable to mechanical, hydraulic or other signal means for transmitting information. In almost all control systems some combination of electrical, pneumatic, mechanical or hydraulic signals will be used. However, use of any other type of signal transmission, compatible with the process and equipment in use, is within the scope of the invention.

A digital computer is used in the preferred embodiment of this invention to calculate the required control signals based on measured process parameters as well as set points supplied to the computer. Analog computers or other types of computing devices could also be used in the invention. The digital computer is preferably an OPTROL 7000 Process Computer System from Applied Automation, Inc., Bartlesville, Oklahoma.

Both the analog and digital controllers shown may utilize the various modes of control such as proportional, proportional-integral, proportional-derivative, or proportional-integral-derivative. In this preferred embodiment, proportional-integral-derivative controllers are utilized but any controller capable of accepting two input signals and producing a scaled output signal, representative of a comparison of the two input signals, is within the scope of the invention. The operation of proportional-integral-derivative controllers is well known in the art. The output control signal of a proportional-integral-derivative controller may be represented as $$S=K_1E+K_2\int Edt+K_3dE/dt$$

where

S = output control signals;

E = difference between two input signals; and $K_1$, $K_2$ and $K_3$ = constants.

The scaling of an output signal by a controller is well known in control systems art. Essentially, the output of a controller may be scaled to represent any desired factor or variable. An example of this is where a desired flow rate and an actual flow rate is compared by a controller. The output could be a signal representative of a desired change in the flow rate of some gas necessary to make the desired and actual flows equal. On the other hand, the same output signal could be scaled to represent a percentage or could be scaled to represent a temperature change required to make the desired and actual flows equal. If the controller output can range from 0 to 10 volts, which is typical, then the output signal could be scaled so that an output signal having a voltage level of 5.0 volts corresponds to 50 percent, some specified flow rate, or some specified temperature.

The various transducing means used to measure parameters which characterize the process and the various signals generated thereby may take a variety of forms or formats. For example, the control elements of the system can be implemented using electrical analog, digital electronic, pneumatic, hydraulic, mechanical or other similar types of equipment or combinations of one or more of such equipment types. While the presently preferred embodiment of the invention preferably utilizes a combination of pneumatic final control elements in conjunction with electrical analog signal handling and translation apparatus, the apparatus and method of the invention can be implemented using a variety of specific equipment available to and understood by those skilled in the process control art. Likewise, the format of the various signals can be modified substantially in order to accommodate signal format requirements of the particular installation, safety factors, the physical characteristics of the measuring or control instruments and other similar factors. For example, a raw flow measurement signal produced by a differential pressure orifice flow meter would ordinarily exhibit a generally proportional relationship to the square of the actual flow rate. Other measuring instruments might produce a signal which is proportional to the measured parameter, and still other transducing means may produce a signal which bears a more complicated, but known, relationship to the measured parameter. Regardless of the signal format or the exact relationship of the signal to the parameter which it represents, each signal representative of a measured process parameter or representative of a desired process value will bear a relationship to the measured parameter or desired value which permits designation of a specific measured or desired value by a specific signal value. A signal which is representative of a process measurement or desired process value is therefore one from which the information regarding the measured or desired value can be readily retrieved regardless of the exact mathematical relationship between the signal units and the measured or desired process units.

Referring now to the drawings and in particular to FIG. 1, a gas oil feed is supplied through the combination of conduit means 11, heat exchanger 12 and conduit means 13 to the riser portion of the reactor 15. A heating fluid is supplied to the heat exchanger 12 through conduit means 16. Steam is supplied to the reactor 15 through conduit means 17.

A zeolite cracking catalyst is generally preferred for an FCCU but any suitable cracking catalyst may be utilized. Fresh catalyst is supplied from the catalyst regenerator 18 to the riser portion of the reactor 15 through conduit means 19. Spent catalyst is removed from the reactor 15 and is provided to the regenerator 18 through conduit means 21. Carbon is burned off of the spent catalyst in the regenerator 18 to produce the fresh catalyst which is provided through conduit means 19.

Hot flue gas is removed from the regenerator 18 and is provided through conduit means 24 to the settler 25. Fine particles are separated from the flue gas in the settler 25 and are removed through conduit means 26. Hot gases are removed from the settler 25 and are provided through the combination of conduit means 28 and 29 to the expander 31. The hot gases flowing through conduit means 28 may be bypassed around the expander 31 through conduit means 34. The hot gases flowing through conduit means 29 are removed from the expander 31 through conduit means 36. The hot gases are utilized to provide a driving force for the air blower 37 which is operably coupled to the expander 31 by means of shaft 38 which also extends through the air blower 37 to the steam turbine 39. Steam is provided to the turbine 39 through conduit means 41 and is removed through conduit means 42.

Ideally, the expander 31 is utilized to provide as much of the driving force required by the air blower 37 as possible. The turbine 39 is utilized only to supplement the expander 31.

Air is provided from the air blower 37 through the combination of conduit means 44 and 45 to the regenerator 18. Air may be vented through conduit means 46.

The reaction product is removed from the reactor 15 and is provided through conduit means 51 to the fractionator 52. The reaction product flowing through conduit means 51 will generally be made up of light olefins, gasoline, light cycle oil, heavy cycle oil and components of the feed which were not cracked in the reactor 15.

An overhead stream is withdrawn from the fractionator 52 and is provided through conduit means 54, heat exchanger 55 and conduit means 56 to the overhead accumulator 58. A cooling fluid is provided to the heat exchanger 55 through conduit means 59. A first portion of the liquid in the overhead accumulator 58 is withdrawn and is provided through the combination of conduit means 61 and 62 as an external reflux to the fractionator 52. A second portion of the liquid in the overhead accumulator 58 is provided through the combination of conduit means 61 and 64 as the gasoline product from the fractionator 52.

Vapor in the overhead accumulator 58 is withdrawn and is provided through conduit means 66 to the suction inlet of the compressor 68. The compressed vapors are provided from the discharge outlet of the compressor 68 through conduit means 71 to the primary absorber for an FCCU gas plant (not illustrated).

Power is provided to the compressor 68 from the turbine 69 which is operably connected to the compressor 68 through drive shaft 74. Steam is provided to the turbine 69 through conduit means 75 and is removed through conduit means 76.

A light cycle oil draw is removed from a central portion of the fractionator 52 through conduit means 78. A heavy cycle oil draw is removed from a lower portion of the fractionator 52 through conduit means 79. A portion of the heavy cycle oil draw flowing through conduit means 79 is recycled as a pumparound to the fractionator 52 through the combination of conduit means 81, heat exchanger 82 and conduit means 83. A cooling fluid is provided to the heat exchanger 82 through conduit means 84. The portion of the heavy cycle oil draw which is not recycled through conduit means 81 is removed as a product through conduit means 86.

A bottoms material is withdrawn from the fractionator 52 through conduit means 91. A portion of the thus withdrawn bottoms is recycled to the fractionator 52 through the combination of conduit means 93, heat exchanger 94 and conduit means 95. A cooling fluid is provided to the heat exchanger 94 through conduit means 97. The portion of the bottoms product flowing through conduit means 91, which is not recycled through conduit means 93, is provided through conduit means 98 to the riser portion of the reactor 15. It is noted that, in general, it is desirable to minimize the recycle of bottoms material to the riser reactor since the bottoms material flowing through conduit means 98 is very difficult to crack.

The FCCU described to this point is a conventional FCCU. Conventional equipment not required for an explanation of the invention has not been illustrated and described. Also, many of the process streams illustrated would be controlled by well known techniques but since these particular control configurations play no part in the explanation of the present invention, the standard control configurations are not described for the sake of simplicity.

A detailed description of the unique control system of the present invention which allows shifting of loads to avoid process constraints so as to substantially maximize the production of gasoline or some other desired product is as follows. The control system will be described in terms of the process measurements required and the process control signals generated and then in terms of the manner in which the process control signals are generated in response to the process measurements.

Pressure transducer 111 in combination with a pressure sensing device operably located in conduit means 66 provides an output signal 112 which is representative of the suction pressure for the wet gas compressor 68. Signal 112 is provided from the pressure transducer 111 as an input to computer means 100.

Temperature transducer 114 in combination with a temperature measuring device which is operably located in the riser portion of the reactor 15 provides an output signal 116 which is representative of the preheat temperature in the riser portion of the reactor 15. As used herein, the term "preheat temperature" refers to the temperature of the feed prior to contacting with the catalyst. Signal 116 is provided from the temperature transducer 114 as an input to computer means 100.

Differential pressure transducer 117 in combination with two pressure sensing devices which are located on opposite sides of the control valve 119 provides an output signal 121 which is representative of the differential pressure across control valve 119. Signal 121 is provided from the differential pressure transducer 117 as an input to computer means 100. The differential pressure across control valve 119 may be referred to as the differential pressure between the regenerator 18 and the reactor 15.

Pressure transducer 123 in combination with a pressure sensing device which is operably located in the regenerator 18 provides an output signal 124 which is representative of the regenerator pressure. Signal 124 is provided from the pressure transducer 123 as an input to computer means 100.

Speed transducer 126 in combination with a speed measuring device which is operably associated with the drive shaft 38 provides an output signal 128 which is representative of the speed of the air blower 37. Signal 128 is provided from the speed transducer 126 as an input to computer means 100.

In response to the described process variable inputs and a number of set points and limits, which will be more fully described hereinafter, computer means 100 establishes four control signals which are utilized to implement the load transfers previously described.

Signal 131 is representative of the speed of the wet gas compressor 68 required to maintain a desired suction pressure. Signal 131 is provided from computer means 100 as a set point input to the speed controller 132. The speed transducer 133 in combination with a speed measuring device which is operably associated with the drive shaft 74 provides an output signal 135 which is representative of the actual speed of the wet gas compressor 68. Signal 135 is provided from the speed transducer 133 as the process variable input to the speed controller 132. In response to signals 131 and 135, the speed controller 132 provides an output signal 136 which is responsive to the difference between signals 131 and 135. Signal 136 is scaled so as to be representative of the flow rate of steam through conduit means 75 required to maintain the actual speed of the wet gas compressor 68 as represented by signal 135 substantially equal to the desired speed for the wet gas compressor 68 as represented by signal 131. Signal 136 is provided from the speed controller 132 as a control signal to the control valve 137. The control valve 137 is manipulated in response to 136 to thereby maintain a required steam flow rate to the turbine 69.

Signal 141 is representative of the desired temperature in the riser portion of the reactor 15. Signal 141 is provided from computer means 100 as a set point input to the temperature controller 143. The temperature transducer 144 in combination with a temperature measuring device operably located in riser portion of reactor 15 provides an output signal 146 which is representative of the actual temperature in the riser portion of the reactor 15 after the feedstock and catalyst have been combined (reaction temperature). Signal 146 is provided from the temperature transducer 144 as the process variable input to the temperature controller 143. In response to signals 141 and 146, the temperature controller 143 establishes an output signal 147 which is responsive to the difference between signals 141 and 146. Signal 147 is scaled so as to be representative of the flow rate of the catalyst flowing through conduit means 19 required to maintain a desired reaction temperature in the riser portion of the reactor 15. Signal 147 is provided from the temperature controller 143 as a control signal to the control valve 119. The control valve 119 is manipulated in response to signal 147 to thereby maintain a desired flow rate of the catalyst flowing through conduit means 19.

Signal 151 is representative of the flow rate of the heating fluid flowing through conduit means 16 required to maintain a desired preheat temperature in the riser portion of the reactor 15. Signal 151 is provided from computer means 100 as a set point signal to the flow controller 152. The flow transducer 153 in combination with the flow sensor 154 which is operably located in conduit means 16 provides an output signal 156 which is representative of the actual flow rate of the heating fluid flowing through conduit means 16. Signal 156 is provided as the process variable input to the flow controller 152. In response to signals 151 and 156, the flow controller 152 establishes an output signal 157 which is responsive to the difference between signals 151 and 156. Signal 157 is scaled so as to be representative of the flow rate of the heating fluid flowing through conduit means 16 required to maintain a desired preheat temperature in the riser portion of the reactor 15. Signal 157 is provided from the flow controller 152 as a control signal to the control valve 159 which is operably located in conduit means 16. The control valve 159 is manipulated in response to signal 157 to thereby maintain a desired flow rate of the heating fluid flowing through conduit means 16.

Signal 161 is representative of the pressure required in conduit means 28 to maintain a desired differential pressure between the regenerator 18 and the reactor 15. Signal 161 is provided from computer means 100 as a set point signal to the pressure controller 162. The pressure transducer 164 in combination with a pressure sensing device operably located in conduit means 28 provides an output signal 165 which is representative of the actual pressure in conduit means 28. Signal 165 is provided as a process variable signal to the pressure controller 162. In response to signals 161 and 165, the pressure controller 162 establishes an output signal 167 which is responsive to the difference between signals 161 and 165. Signal 167 is scaled so as to be representative of the flow rate of the gas flowing through conduit means 28 required to maintain a desired pressure in conduit means 28. Signal 167 is provided from the pressure controller 162 as a control signal to the control valve 168 which is operably located in conduit means 28. The control valve 168 is manipulated in response to signal 167 to thereby maintain a desired pressure in coduit means 28.

The computer logic utilized to generate the described control signals in response to the described process variables supplied to the computer is illustrated in FIG. 2. Referring now to FIG. 2, signal 112, which is representative of the actual suction pressure for the wet gas compressor 68, is provided as an input to the proportional-integral-derivative (P-I-D) block 171 and the P-I-D block 172. Signal 173, which is representative of the desired suction pressure for the wet gas compressor, is provided as a set point input to the P-I-D block 171. In response to signals 112 and 173, the P-I-D block 171 establishes an output signal 175 which is responsive to the difference between signals 112 and 173. Signal 175 is scaled so as to be representative of the flow rate of steam to the turbine 69 required to maintain the actual suction pressure for the wet gas compressor 68 substantially equal to the desired suction pressure. Signal 175 is provided from the P-I-D block 171 to the low select block 178. The low select block 178 is also provided with signal 179 which is representative of the maximum allowable flow rate of steam to the turbine 69. In general, the signal 175 is supplied by the low select 178 as the control signal 131 unless the magnitude of signal 175 exceeds the magnitude of 179. Signal 131 is provided as a process control signal from computer means 100 and is utilized as has been previously described.

The P-I-D block 172 is also provided with signal 181 which is representative of the maximum allowable suction pressure for the wet gas compressor 68. The magnitude of signal 181 is generally determined by metallurgical considerations. In response to signals 181 and 112, the P-I-D block 172 establishes an output signal 182 which is scaled so as to be representative of the maximum reaction temperature in the riser portion of the reactor 15 which may be achieved without exceeding the maximum suction pressure for the wet gas compressor. As temperature rises in the reactor 15, more light components are formed which tends to increase the suction pressure for the wet gas compressor if a speed limitation on the wet gas compressor is reached. Signal 182 effectively prevents the temperature in the reactor 15 from rising to a point which would force the suction pressure for the wet gas compressor above a maximum limit. Signal 182 is provided from the P-I-D block 172 as one input to the low select block 184. Signal 185, which is representative of the desired reaction temperature in the riser portion of the reactor 15, is provided as a second input to the low select 184.

Signal 128, which is representative of the actual speed of the air blower 37, is provided as an input signal to the P-I-D block 187. The P-I-D block 187 is also provided with signal 189 which is representative of the maximum allowable air blower speed. In response to signals 128 and 189, the P-I-D block 187 establishes an output signal 191 which is scaled so as to be representative of the maximum allowable reaction temperature in the riser portion of the reactor 15 which may be achieved without exceeding a limitation on the air blower speed. In general, the flow rate of the catalyst flowing through conduit means 19 is increased to increase the reaction temperature. However, as the flow rate of catalyst increases, more air must be supplied to the regenerator 18. Signal 191 effectively prevents the flow rate of the catalyst flowing through conduit means 19 from exceeding a flow rate which would force the air blower above a maximum speed to supply sufficient air to regenerate the catalyst. Signal 191 is provided as a third input to the low select 184. The low select 184 selects the lower of signals 182, 185 and 191 to provide as signal 141. Signal 141 is provided from computer means 100 and is utilized as has been previously described.

In general, signal 185 is provided as signal 141. Only if the magnitude of signal 185 should go above the magnitude of signals 182 or 191 will the limits represented by signals 182 and 191 come into force.

Signal 116, which is representative of the preheat temperature in the riser portion of the reactor 15, is provided as an input signal to the P-I-D block 193 and the P-I-D block 194. The P-I-D block 193 is also provided with a signal 195 which is representative of the maximum allowable preheat temperature in the riser portion of the reactor 15. In response to signals 116 and 195, the P-I-D block 193 establishes an output signal 196 which is provided through the switch 197 as one input to the high select 198. Signal 196 is scaled so as to be representative of a flow rate of heating fluid flowing through conduit means 16 which will force the preheat temperature to move towards the maximum preheat temperature represented by signal 195. The switch 197 may be considered a software decision block. The switch 197 is closed only if the air blower speed has reached a maximum and it is necessary to supply additional preheat to maintain a desired reaction temperature in the riser portion of the reactor 15. Thus, switch 197 will be closed only when the air blower speed has reached a maximum.

The P-I-D block 194 is also provided with a set point signal 200 which is representative of the desired preheat temperature. In response to signals 116 and 200, the P-I-D block 194 establishes an output signal 211 which is responsive to the difference between signals 116 and 200. Signal 211 is scaled so as to be representative of the flow rate of heating fluid flowing through conduit means 16 required to maintain the preheat temperature substantially equal to the desired preheat temperature represented by signal 200. Signal 211 is provided from the P-I-D block 194 as a second input to the high select 198.

Signal 121, which is representative of the pressure differential across the control valve 119, is provided as an input to the P-I-D block 212 and the P-I-D block 214. The P-I-D block 212 is also provided with signal 216 which is representative of the minimum allowable differential pressure across the control valve 119. This differential pressure is determined by the differential pressure which will effectively ensure that feed cannot flow to the regenerator 18. In response to signals 121 and 216, the P-I-D block 212 establishes an output signal 218 which is responsive to the difference between signals 121 and 216. Signal 218 is scaled so as to be representative of the maximum preheat temperature which may be achieved without allowing the actual pressure differential across the control valve 119 to go below the minimum pressure differential represented by signal 216. signal 218 is provided from the P-I-D block 212 as an input to the high select 198.

The higher of signals 196, 211 and 218 is provided from the high select 198 as signal 151. Signal 151 is provided as a control signal from computer means 100 and is utilized as has been previously described. In general, signal 211 is provided as signal 151 from the high select 198. Signal 218 effectively prevents the preheat temperature from going below a temperature which would cause the desired pressure differential across the control valve 119 to go below the minimum pressure differential represented by signal 216. When switch 197 is closed signal 196 will be provided as the controlling signal 151. This will force the preheat temperature to begin to rise until the air blower speed is no longer a limit. Minimization of the preheat temperature by utilizing signal 211 as a general controlling signal provides for maximum conversion because the catalyst circulation rate is increased to maintain the desired reaction temperature. Use of an increased preheat temperature when an air blower constraint is met allows production to be increased without exceeding an air blower limitation but may reduce conversion and/or change the cracking pattern.

The P-I-D block 214 is also provided with signal 221 which is representative of the desired differential pressure across the control valve 119. Preferably, the differential pressure across the control valve 119 is held as low as possible to minimize the pressure in the regenerator which reduces the work required of the air blower 37. In response to signals 121 and 221 the P-I-D block 214 establishes an output signal 222 which is responsive to the difference between signals 121 and 221. Signal 222 is scaled so as to be representative of the pressure in conduit means 28 required to maintain a desired differential pressure across the control valve 119. Signal 222 is provided as one input to the high select 224.

Signal 124, which is representative of the actual pressure in the regenerator 18, is provided as an input signal to the P-I-D block 226. The P-I-D block 226 is also provided with signal 227 which is representative of the minimum allowable pressure in the regenerator 18. In response to signals 124 and 127, the P-I-D block 226 establishes an output signal 228 which is responsive to the difference between signals 124 and 227. Signal 228 is scaled so as to be representative of the pressure in conduit means 28 required to maintain a required minimum pressure in the regenerator 18 as represented by signal 227. Signal 228 is provided from the P-I-D block 226 as a second input to the high select 224.

The high select 224 provides the higher of signals 222 and 228 as the control signal 161. The control signal 161 is provided from computer means 100 and is utilized as has been previously described. In general, signal 222 is provided as signal 161. Only if signal 222 goes below the magnitude of signal 228 which would indicate that signal 222 would allow the regenerator pressure to drop below a desired minimum will signal 228 become the controlling signal.

In summary, the control system of the present invention allows the suction pressure for the wet gas compressor to rise when the wet gas compressor reaches a maximum speed. When the suction pressure for the wet gas compressor begins to rise the control system also forces the regenerator pressure to rise to maintain a desired pressure differential across the control valve 119. This forces the air blower 37 to do more work and effectively transfers load from the wet gas compressor to the air blower 37 when the wet gas compressor 68 becomes a limiting factor. In like manner, if the speed of the air blower 37 should become limiting, load is automatically shifted from the air blower 37 by increasing the preheat temperature. In this manner, production is substantially maximized without exceeding a process constraint.

The invention has been described in terms of a preferred embodiment as illustrated in FIGS. 1 and 2. Specific control components which can be used in the practice of the invention as illustrated in FIG. 1 such as pressure transducers 111, 123 and 164; speed transducers 133 and 126; speed controller 132; flow transducer 153; flow controller 152; temperature transducers 114 and 144; temperature controller 143; differential pressure transducer 117; pressure controller 162 and the many control valves illustrated are each well known, commercially available control components such as are illustrated and described at length in Perry's *Chemical Engineer's Handbook*, 4th Edition, Chapter 22, McGraw-Hill.

While the invention has been described in terms of the presently preferred embodiment, reasonable variations and modifications are possible by those skilled in the art and such variations and modifications are within the scope of the described invention and the appended claims.

That which is claimed is:

1. Apparatus comprising:

a reactor;

a catalyst regenerator;

a fractionator;

means for supplying a feed to said reactor;

means for supplying a regenerated cracking catalyst from said catalyst regenerator to said reactor;

means for removing cracking catalyst contaminated by carbon from said reactor and for supplying the thus removed cracking catalyst to said catalyst regenerator;

air blower means for supplying a free oxygen-containing gas to said regenerator;

means for removing hot flue gases from said catalyst regenerator;

means for removing the products produced by the cracking of said feed from said reactor and for supplying the thus removed products as a feed to said fractionator;

cooling means;

accumulator means;

means for withdrawing an overhead stream from said fractionator and for supplying the thus withdrawn overhead stream through said cooling means to said accumulator means;

a compressor;

means for withdrawing uncondensed vapors from said accumulator and for supplying the thus withdrawn uncondensed vapors to the suction inlet of said compressor;

means for establishing a first signal representative of the actual suction pressure for said compressor;

means for establishing a second signal representative of the desired suction pressure for said compressor;

means for comparing said first signal and said second signal and for establishing a third signal responsive to the difference between said first signal and said second signal, wherein said third signal is scaled so as to be representative of the speed of said compressor required to maintain the actual suction pressure represented by said first signal substantially equal to the desired suction pressure represented by said second signal;

means for controlling the speed of said compressor in response to said third signal;

means for establishing a fourth signal representative of the differential pressure between said catalyst regenerator and said reactor;

means for establishing a fifth signal representative of the desired differential pressure between said catalyst regenerator and said reactor;

means for comparing said fourth signal and said fifth signal and for establishing a sixth signal responsive to the difference between said fourth signal and said fifth signal, wherein said sixth signal is scaled so as to be representative of the pressure of the flue gas flowing from said catalyst regenerator required to maintain the actual differential pressure between said catalyst regenerator and said reactor represented by said fourth signal substantially equal to the desired differential pressure between said catalyst regenerator and said reactor represented by said fifth signal; and means for manipulating the pressure of said flue gas in response to said sixth signal, wherein the suction pressure for said compressor rises when a compressor speed limit is reached to effectively shift loading from said compressor to said air blower by raising the pressure in said catalyst regenerator to maintain a desired pressure differential between said catalyst regenerator and said reactor as the suction pressure for said compressor rises.

2. Apparatus in accordance with claim 1 additionally comprising:

means for establishing a seventh signal representative of the actual pressure in said catalyst regenerator;

means for establishing an eighth signal representative of a minimum pressure limit for said catalyst regenerator;

means for comparing said seventh signal and said eighth signal and for establishing a ninth signal responsive to the difference between said seventh signal and said eighth signal, wherein said ninth signal is scaled so as to be representative of the pressure of said flue gas required to maintain the actual pressure in said regenerator as represented by said seventh signal above the minimum pressure limit represented by said eighth signal; and means for manipulating the pressure of said flue gas in response to said ninth signal if the magnitude of said ninth signal is greater than the magnitude of said sixth signal.

3. Apparatus in accordance with claim 2 wherein said means for manipulating the pressure of said flue gas in response to said sixth signal or said ninth signal comprises:

high select means;

means for supplying said sixth signal and said ninth signal to said high select means, wherein the higher of said sixth and ninth signals is provided as a tenth signal from said high select means;

means for establishing an eleventh signal representative of the actual flue gas pressure;

means for comparing said tenth signal and said eleventh signal and for establishing a twelfth signal responsive to the difference between said tenth signal and said eleventh signal, wherein said twelfth signal is scaled so as to be representative of the flow rate of said flue gas required to maintain the actual pressure of said flue gas as represented by said eleventh signal substantially equal to the desired pressure represented by said tenth signal; and means for manipulating the flow of said flue gas in response to said twelfth signal.

4. Apparatus in accordance with claim 1 wherein said means for manipulating the speed of said compressor in response to said third signal comprises:

a turbine operably connected by a drive shaft to said compressor means;

means for supplying steam to said turbine;

means for establishing a seventh signal representative of a high limit on the speed of said compressor;

low select means;

means for providing said third signal and said seventh signal to said low select means, wherein the lower of said third and seventh signals is provided as an eighth signal from said low select means;

means for establishing a ninth signal representative of the actual speed of said compressor;

means for comparing said eighth signal and said ninth signal and for establishing a tenth signal responsive to the difference between said eighth signal and said ninth signal; and means for manipulating the flow of steam to said turbine in response to said tenth signal to thereby maintain the actual speed of said compressor represented by said ninth signal substantially equal to the desired speed for said compressor represented by said eighth signal.

5. Apparatus in accordance with claim 1 additionally comprising:

means for establishing a seventh signal representative of the desired reaction temperature in said reactor;

means for establishing an eight signal representative of the actual speed of said air blower;

means for establishing a ninth signal representative of a high limit for the speed of said air blower;

means for comparing said eighth signal and said ninth signal and for establishing a tenth signal responsive to the difference between said eighth signal and said ninth signal, wherein said tenth signal is scaled so as to be representative of the maximum reaction temperature in said reactor which may be achieved without exceeding the high limit represented by said ninth signal;

low select means;

means for providing said seventh signal and said tenth signal to low select means, wherein the lower of said seventh and tenth signals is provided as an eleventh signal from said low select means; and means for manipulating the reaction temperature in said reactor in response to said eleventh signal.

6. Apparatus in accordance with claim 5 additionally comprising:

means for establishing a twelfth signal representative of a high limit for the suction pressure of said compressor;

means for comparing said first signal and said twelfth signal and for establishing a thirteenth signal responsive to the difference between said first signal and said twelth signal, wherein said thirteenth signal is scaled so as to be representative of the maximum reaction temperature in said reactor which may be achieved without exceeding the high limit on the suction pressure for said compressor; and means for providing said thirteenth signal to said low select means, wherein said thirteenth signal is provided as said eleventh signal if the magnitude of said thirteenth signal is less than the magnitude of said seventh signal and said tenth signal.

7. Apparatus in accordance with claim 6 wherein said means for manipulating the reaction temperature in said reactor in response to said eleventh signal comprises:

means for establishing a fourteenth signal representative of the actual reaction temperature in said reactor;

means for comparing said eleventh signal and said fourteenth signal and for establishing a fifteenth signal responsive to the difference between said eleventh signal and said fourteenth signal, wherein said fifteenth signal is scaled so as to be representative of the flow rate of said regenerated catalyst to said reactor required to maintain the actual reaction temperature in said reactor substantially equal to the desired reaction temperature in said reactor represented by said eleventh signal; and means for manipulating the flow rate of said regenerated catalyst in response to said fifteenth signal.

8. Apparatus in accordance with claim 5 additionally comprising:

a heat exchange means;

means for providing a heating fluid to said heat exchange means;

means for passing said feed through said heat exchange means prior to introducing said feed into said reactor;

means for establishing a twelfth signal representative of the temperature of said feed in said reactor before said feed is contacted with said regenerated catalyst (preheat temperature);

means for establishing a thirteenth signal representative of the desired preheat temperature;

means for comparing said twelfth signal and said thirteenth signal and for establishing a fourteenth signal responsive to the difference between said twelfth signal and said thirteenth signal, wherein said fourteenth signal is scaled so as to be representative of the flow rate of said heating fluid required to maintain the actual preheat temperature substantially equal to the desired preheat temperature;

means for establishing a fifteenth signal representative of a high limit on said preheat temperature;

means for comparing said twelfth signal and said fifteenth signal and for establishing a sixteenth signal responsive to the difference between said twelfth signal and said fifteenth signal;

means for establishing a seventeenth signal representative of a minimum limit on the differential pressure between said catalyst regenerator and said reactor;

means for comparing said fourth signal and said seventeenth signal and for establishing an eighteenth signal responsive to the difference between said fourth signal and said seventeenth signal, wherein said eighteenth signal is scaled so as to be representative of the preheat temperature required to maintain the actual differential pressure between said catalyst regenerator and said reactor above the minimum pressure limit representated by said seventeenth signal;

high select means;

means for providing said fourteenth signal, said sixteenth signal and said eighteenth signal to said high select means, wherein said sixteenth signal is provided to said high select means only if the actual speed of said air blower is equal to the high limit for the speed of said air blower and wherein said high select means establishes a nineteenth signal representative of the higher of the signals provided to said high select means; and means for manipulating said preheat temperature in response to said nineteenth signal.

9. Apparatus in accordance with claim 8 wherein said means for manipulating said preheat temperature in response to said nineteenth signal comprises:

means for establishing a twentieth signal representative of the actual flow rate of said heating fluid;

means for comparing said nineteenth signal and said twentieth signal and for establishing a twenty-first signal responsive to the difference between said nineteenth signal and said twentieth signal; and means for manipulating the flow rate of said heating fluid in response to said twenty-first signal.

10. A method for controlling a fluid catalytic cracking unit, wherein a feed provided to a reactor is contacted with a regenerated cracking catalyst provided to the reactor from a catalyst regenerator to produce a product stream which is provided from said reactor to a fractionator, wherein cracking catalyst contaminated by carbon is provided from said reactor to said catalyst regenerator and contacted with a free oxygen-containing gas provided to said catalyst regenerator from an air blower to produce said regenerated catalyst with the resulting hot gases being removed from said catalyst regenerator as a flue gas, and wherein an overhead stream is withdrawn from said fractionator and partially condensed with the uncondensed portion of said overhead stream being provided to the suction inlet of a compressor, said method comprising the steps of:

establishing a first signal representative of the actual suction pressure for said compressor;

establishing a second signal representative of the desired suction pressure for said compressor;

comparing said first signal and said second signal and establishing a third signal responsive to the difference between said first signal and said second signal, wherein said third signal is scaled so as to be representative of the speed of said compressor required to maintain the actual suction pressure represented by said first signal substantially equal to the desired suction pressure represented by said second signal;

controlling the speed of said compressor in response to said third signal;

establishing a fourth signal representative of the differential pressure between said catalyst regenerator and said reactor;

establishing a fifth signal representative of the desired differential pressure between said catalyst regenerator and said reactor;

comparing said fourth signal and said fifth signal and establishing a sixth signal responsive to the difference between said fourth signal and said fifth signal, wherein said sixth signal is scaled so as to be representative of the pressure of the flue gas flowing from said catalyst regenerator required to maintain the actual differential pressure between said catalyst regenerator and said reactor represented by said fourth signal substantially equal to the desired differential pressure between said catalyst regenerator and said reactor represented by said fifth signal; and manipulating the pressure of said flue gas in response to said sixth signal, wherein the suction pressure for said compressor rises when a compressor speed limit is reached to effectively shift loading from said compressor to said air blower by raising the pressure in said catalyst regenerator to maintain a desired pressure differential between said catalyst regenerator and said reactor as the suction pressure for said compressor rises.

11. A method in accordance with claim 10 additionally comprising the steps of:

establishing a seventh signal representative of the actual pressure in said catalyst regenerator;

establishing an eighth signal representative of a minimum pressure limit for said catalyst regenerator;

comparing said seventh signal and said eighth signal and establishing a ninth signal responsive to the difference between said seventh signal and said eighth signal, wherein said ninth signal is scaled so as to be representative of the pressure of said flue gas required to maintain the actual pressure in said regenerator as represented by said seventh signal above the minimum pressure limit represented by said eighth signal; and manipulating the pressure of said flue gas in response to said ninth signal if the magnitude of said ninth signal is greater than the magnitude of said sixth signal.

12. A method in accordance with claim 11 wherein said step of manipulating the pressure of said flue gas in response to said sixth signal or said ninth signal comprises:

establishing a tenth signal representative of the higher of said sixth and ninth signals;

establishing an eleventh signal representative of the actual flue gas pressure;

comparing said tenth signal and said eleventh signal and establishing a twelfth signal responsive to the difference between said tenth signal and said eleventh signal, wherein said twelfth signal is scaled so as to be representative of the flow rate of said flue gas required to maintain the actual pressure of said flue gas as represented by said eleventh signal substantially equal to the desired pressure represented by said tenth signal; and manipulating the flow of said flue gas in response to said twelfth signal.

13. A method in accordance with claim 10 wherein said compressor is driven by a steam turbine and wherein said step of manipulating the speed of said compressor in response to said third signal comprises:

establishing a seventh signal representative of a high limit on the speed of said compressor;

establishing an eighth signal representative of the lower of said third and seventh signals;

establishing a ninth signal representative of the actual speed of said compressor;

comparing said eighth signal and said ninth signal and establishing a tenth signal responsive to the difference between said eighth signal and said ninth signal; and manipulating the flow of steam to said turbine in response to said tenth signal to thereby maintain the actual speed of said compressor represented by said ninth signal substantially equal to the desired speed for said compressor represented by said eighth signal.

14. A method in accordance with claim 10 additionally comprising the steps of:

establishing a seventh signal representative of the desired reaction temperature in said reactor;

establishing an eight signal representative of the actual speed of said air blower;

establishing a ninth signal representative of a high limit for the speed of said air blower;

comparing said eighth signal and said ninth signal and establishing a tenth signal responsive to the difference between said eighth signal and said ninth signal, wherein said tenth signal is scaled so as to be representative of the maximum reaction temperature in said reactor which may be achieved without exceeding the high limit represented by said ninth signal;

establishing an eleventh signal representative of the lower of said seventh and tenth signals;

manipulating the reaction temperature in said reactor in response to said eleventh signal.

15. A method in accordance with claim 14 additionally comprising the steps of:

establishing a twelfth signal representative of a high limit for the suction pressure of said compressor; and comparing said first signal and said twelfth signal and establishing a thirteenth signal responsive to the difference between said first signal and said twelth signal, wherein said thirteenth signal is scaled so as to be representative of the maximum reaction temperature in said reactor which may be achieved without exceeding the high limit on the suction pressure for said compressor, wherein said thirteenth signal is established as said eleventh signal if the magnitude of said thirteenth signal is less than the magnitude of said seventh signal and said tenth signal.

16. A method in accordance with claim 15 wherein said step of manipulating the reaction temperature in said reactor in response to said eleventh signal comprises:

establishing a fourteenth signal representative of the actual reaction temperature in said reactor;

comparing said eleventh signal and said fourteenth signal and for establishing a fifteenth signal responsive to the difference between said eleventh signal and said fourteenth signal, wherein said fifteenth signal is scaled so as to be representative of the flow rate of said regenerated catalyst to said reactor required to maintain the actual reaction temperature in said reactor substantially equal to the desired reaction temperature in said reactor represented by said eleventh signal; and manipulating the flow rate of said regenerated catalyst in response to said fifteenth signal.

17. A method in accordance with claim 14, wherein said feed is passed in heat exchange with a heating fluid prior to entering said reactor, additionally comprising the steps of:

establishing a twelfth signal representative of the temperature of said feed in said reactor before said feed is contacted with said regenerated catalyst (preheat temperature);

establishing a thirteenth signal representative of the desired preheat temperature;

comparing said twelfth signal and said thirteenth signal and establishing a fourteenth signal responsive to the difference between said twelfth signal and said thirteenth signal, wherein said fourteenth signal is scaled so as to be representative of the flow rate of said heating fluid required to maintain the actual preheat temperature substantially equal to the desired preheat temperature;

establishing a fifteenth signal representative of a high limit on said preheat temperature;

comparing said twelfth signal and said fifteenth signal and establishing a sixteenth signal responsive to the difference between said twelfth signal and said fifteenth signal;

establishing a seventeenth signal representative of a minimum limit on the differential pressure between said catalyst regenerator and said reactor;

comparing said fourth signal and said seventeenth signal and establishing an eighteenth signal responsive to the difference between said fourth signal and said seventeenth signal, wherein said eighteenth signal is scaled so as to be representative of the preheat temperature required to maintain the actual differential pressure between said catalyst regenerator and said reactor above the minimum pressure limit representated by said seventeenth signal;

providing said fourteenth signal, said sixteenth signal and said eighteenth signal to said high select means, wherein said sixteenth signal is provided to said high select means only if the actual speed of said air blower is equal to the high limit for the speed of said air blower and wherein said high select means establishes a nineteenth signal representative of the higher of the signals provided to said high select means; and manipulating said preheat temperature in response to said nineteenth signal.

18. A method in accordance with claim 17 wherein said step of manipulating said preheat temperature in response to said nineteenth signal comprises:

establishing a twentieth signal representative of the actual flow rate of said heating fluid;

comparing said nineteenth signal and said twentieth signal and establishing a twenty-first signal responsive to the difference between said nineteenth signal and said twentieth signal; and manipulating the flow rate of said heating fluid in response to said twenty-first signal.

* * * * *